United States Patent [19]

Gabillard et al.

[11] Patent Number: 5,068,655

[45] Date of Patent: Nov. 26, 1991

[54] DEVICE FOR DETECTING THE PASSAGE OF AT LEAST ONE MOBILE BODY IN AT LEAST ONE LOCATION FIXED BY ITS TRAVEL

[75] Inventors: Robert Gabillard, Lille; Yann Nguyen, Dunkerque; Christian Semet, Neuville en Ferrain, all of France

[73] Assignee: Universite des Sciences et Techniques de Lille (U.S.T.L.) Flandres Artois, Villeneuve D'ASCQ, France

[21] Appl. No.: 504,181

[22] Filed: Apr. 4, 1990

[30] Foreign Application Priority Data

Apr. 4, 1989 [FR] France ..... 89 04773

[51] Int. Cl.[5] ..... G08G 1/123; G08B 13/14

[52] U.S. Cl. ..... 340/988; 340/571; 340/572

[58] Field of Search ..... 340/988, 571, 572

[56] References Cited

U.S. PATENT DOCUMENTS

| | | | |
|---|---|---|---|
| 3,895,368 | 7/1975 | Gordon et al. . | |
| 3,990,065 | 11/1976 | Purinton et al. | 340/572 |
| 4,212,002 | 7/1980 | Williamson | 340/572 |
| 4,303,910 | 12/1981 | McCann | 340/572 |
| 4,660,025 | 4/1987 | Humphrey | 340/572 |
| 4,675,658 | 6/1987 | Anderson et al. | 340/572 |
| 4,679,035 | 7/1987 | Pfaff et al. | 340/572 |
| 4,704,602 | 11/1987 | Asbrink . | |
| 4,713,663 | 12/1987 | Drabowitch et al. . | |

FOREIGN PATENT DOCUMENTS

| | | |
|---|---|---|
| 0111591 | 12/1982 | European Pat. Off. . |
| 3027981A1 | 2/1982 | Fed. Rep. of Germany . |
| 2195812 | 3/1974 | France . |
| 2593761 | 10/1987 | France . |

*Primary Examiner*—Donnie L. Crosland

*Attorney, Agent, or Firm*—Kerkam, Stowell, Kondracki & Clarke

[57] ABSTRACT

A device for detecting the passage of at least one mobile body in at least one location fixed by its travel along a path inside of a space in reference to which the said travel of the mobile body is evaluated. It is characterized in that the double reception circuit (29) which includes the responder, consists of two elements (20, 21) which, when the mobile body passes the monitoring location, generate two signals (31, 32) of an appreciably equivalent nature, and in that these elements (20, 21) are designed and connected with each other in such a way as to give opposite values to at least one of the characteristics of these signals (31, 32) which, when combined, form at least one resulting signal (R), at least one of the characteristics of which, at least at one fixed location (13) of the passage of the transmitter at right angles to the responder, changes in an abrupt fashion in accordance with a discernible amplitude variation from possible other variations of the characteristics considered in connection with the said resulting signal (R) and thus constitutes a particularly electric phenomenon hereinafter called top which, in the resulting signal (R), defines two distinct portions, each one of a certain length.

9 Claims, 3 Drawing Sheets

CURRENT (ABSOLUTE VALUE)
31

TIME
CURRENT (ABSOLUTE VALUE)
32

TIME
T1
T0
T2
R
COMBINED CURRENT

R.a
30
R.b
TIME
MOD. CARRIER WAVE R
24

TIME

DEVICE FOR DETECTING THE PASSAGE OF AT LEAST ONE MOBILE BODY IN AT LEAST ONE LOCATION FIXED BY ITS TRAVEL

FIELD OF THE INVENTION

The invention relates to a device for detecting the passage of at least one mobile body in at least one location fixed by its travel along a path inside of a space in reference to which the said travel of the mobile body is evaluated.

More particularly, it is directed to the detection of guided transport means at fixed positions along their travel with a view to, for example, readjust devices for placement and/or calculating of speed, operating with the help of conventional means and subject to errors, for example because of slippage, or to identify at least one mobile body and/or at least one location along its course.

BACKGROUND

Numerous devices for detecting in particular the passage of at least one mobile body in at least one zone described by the space in which the said mobile body advances are already known (French A-2.195.812 and 2.593.761).

These devices comprise two separate parts each, namely an interrogation element and a responder, one of the two separate parts being connected with the mobile body, the other being considered fixed in the space in respect to which the mobile body moves.

The interrogation element itself comprises a transmitting and receiving element.

It is connected to conventional information processing circuits operating in accordance with the planned applications and the processing circuits are connected with an electric power supply.

One of the long-term problems in particular, which has been overcome today is to develop a passive responder thus called because it is supplied by a signal received from the interrogation element and which therefore is without direct electric power supply, whether by batteries or by connection with a distribution net.

In one of the known devices (French A-2.195.812), the interrogation element comprises two transmitters, oriented in the direction of the zone where the passage of the responder is monitored, one of which emits a high frequency signal in the form of electromagnetic waves, the other a very low frequency signal which, in this case, creates an electrostatic field and additionally a receiver for the signal processed by the responder from the signal received from the transmitters during their passage through the aforementioned zone afterwards immediately retransmitted by the said responder. The responder mainly comprises antenna means with which a non-linear component, such as a diode, is connected because of its ability to modify and in particular mix the signals received prior to their re-transmission by the responder in the form of a modulated carrier wave.

The responder then demodulates this signal and processes its very low frequency component.

Conceived for use in monitoring the passage from an exit of a warehouse of articles, in which a sensitive label constitutes the responder, this device calls up an interrogation element, the dimensions of which do not particularly fit the restrictions imposed by the limits of the original pattern on the use by transport means They are mainly sensitive to the presence of a responder in a very large space and therefore, for example, lack the required precision for resetting the position indicators, and they are mainly disturbed by the monitoring means of a parallel channel to the extent that they not supply any information regarding the direction of movement.

In another presently known device (French A-2,593,761), the interrogation element comprises an amplitude modulation means for a high-frequency signal of very high power (approximately 10 GHz and 200 mW) with the aid of a signal of medium frequency (approximately 200 kHz), which does or does not scramble the carrier wave in accordance with the rythm of the frequency of the wave produced by an oscillator, and transmission means of the said high-frequency carrier wave pre-modulated in amplitude in this way towards the location where the passage of a responder is monitored by its movement in respect to the interrogation element.

This interrogation element also comprises reception means of at least one high-frequency carrier wave overmodulated in amplitude by the responder which, at the time when it passes the location monitored by the interrogation element, receives the transmitted signal and distributes, with the aid of a circulator. One fraction is fed to a channel, where a circuit restores the clock signals and applies them to a delay line which will then dephase them to a certain value of less than the size of the pulses, and another fraction to a channel where the already modulated carrier wave will again be cut by the pulses of the delay line.

The carrier wave thus double-cut is immediately retransmitted by the responder towards the receiver, which demodulates and processes the signal by phase comparison.

With such devices it is known to individualize the responders for the purpose of identifying at least one mobile body and at least one location of its movement.

For this purpose, the delay line of the various responders has its own adapted time constant and the phase comparator of the interrogation element receives the correct references during each possible dephasing.

To be able to determine the direction of movement of the mobile body, it is also known to use a responder comprising two signal reception circuits, which are separated from each other in accordance in a direction parallel to the path of the mobile body.

An advantageous known reception circuit device of the responder is called symmetrical, i.e. placed at the same distance from both ends of the re-transmission antenna of the responder.

Taking into account the small space requirement required by the circuits, they are provided in the form of printed circuits.

The disadvantages of this known device lie in the disturbance of the signal originating from channels parallel to the one monitored and, above all, in the lack of accuracy in determinating the passage of the mobile body at right angles to the fixed location in its path, taking into account the exigencies of the means, in particular computer means, assigned to process the information received, for example for determining the speed and insuring the readjustment of the revolution sensors.

SUMMARY OF THE INVENTION

One of the results to be attained by the invention is a very advanced device of the type mentioned which is very precise without, on the other hand, comprising the very expensive or fragile components such as the devices known today.

Therefore it has as an object such a device, particularly characterized in that the double reception circuit which comprises the responder consists of elements which generate two signals of essentially equivalent nature during the passage of the mobile body by the monitored location, and in that these elements are designed and connected with each other in such a way as to give opposite values to at least one of the characteristics of these signals which, when combined, form at least one resulting signal, at least one of the characteristics of which, at least at one fixed location of the passage of the transmitter at right angles to the responder, changes in an abrupt fashion in accordance with a discernible amplitude variation compared with other possible variations of the characteristics considered in connection with the said resulting signal. This thus constitutes a particularly electric phenomenon hereinafter called top which, in the shape of the resulting signal, defines two distinct portions, each one of a certain length.

The invention will be better understood with the aid of description below, provided in a non-limiting manner and making reference to the attached drawings.

DETAILED DESCRIPTION OF THE PREFERRED EMBODIMENTS

Figure 1:
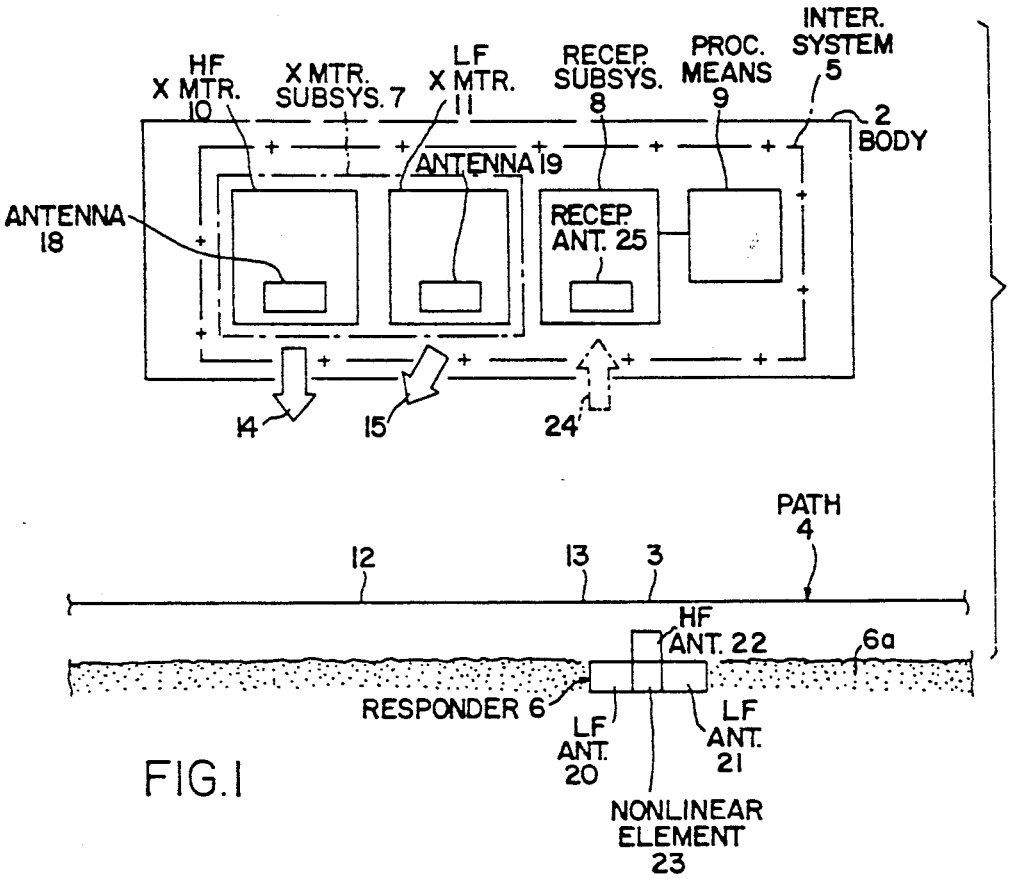
FIG. 1 is the general principle of the device of the invention.
Figure 2:
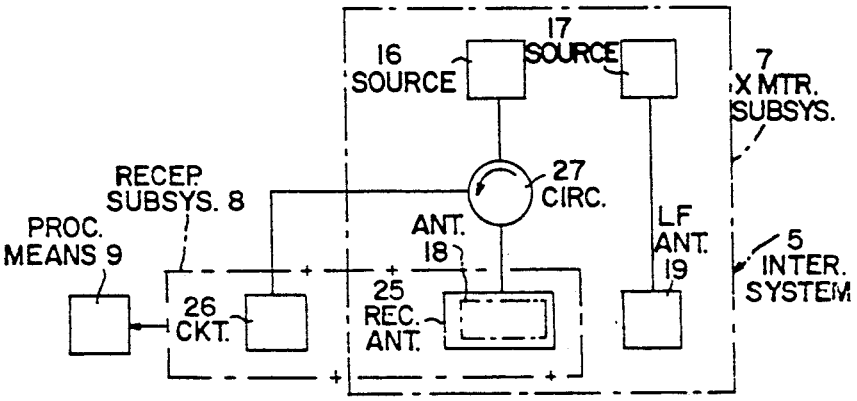
FIG. 2 is a preferred variant of the embodiment of this device.
Figure 3:
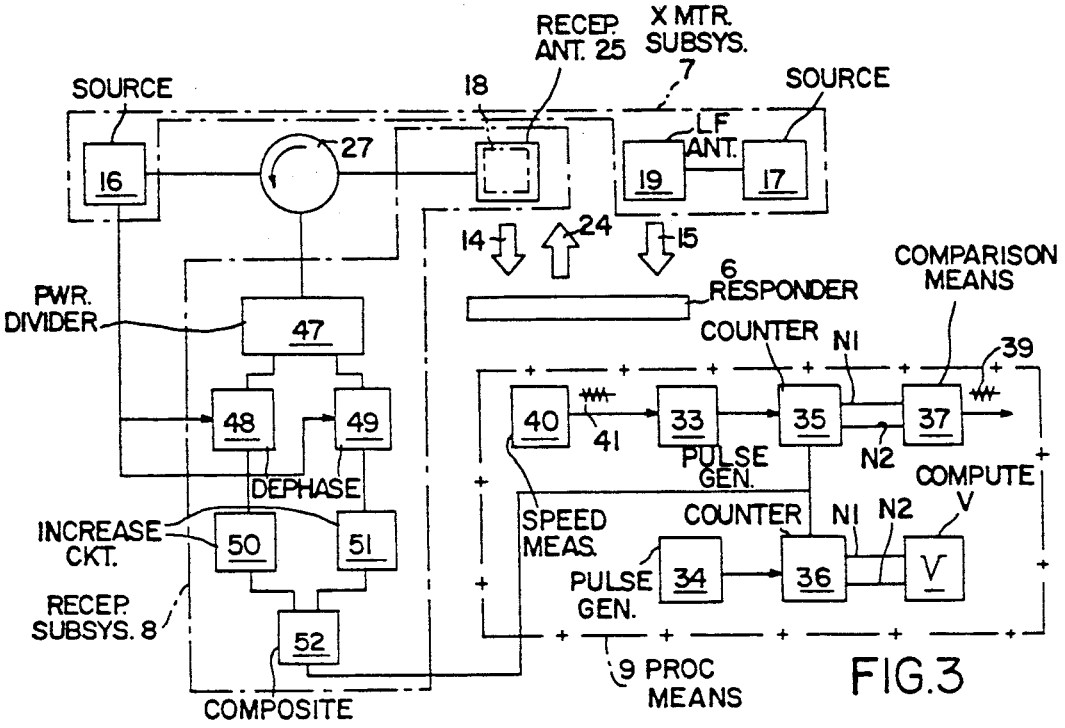
FIG. 3 is a detail of the components of the interrogation element.
Figure 4:
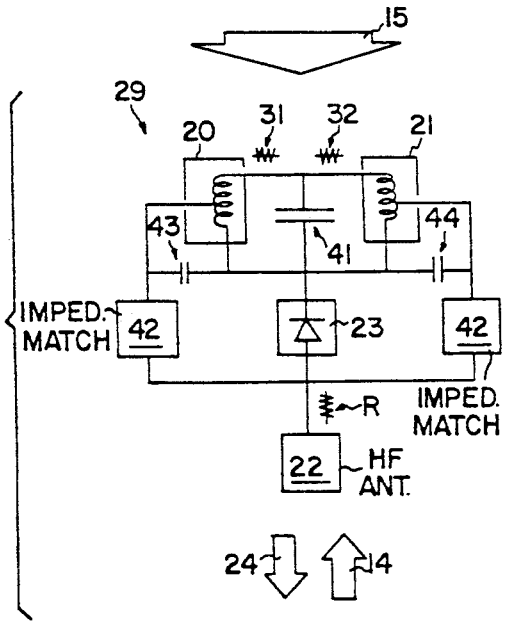
FIG. 4 is the block diagram of the responder antenna.
Figure 5:
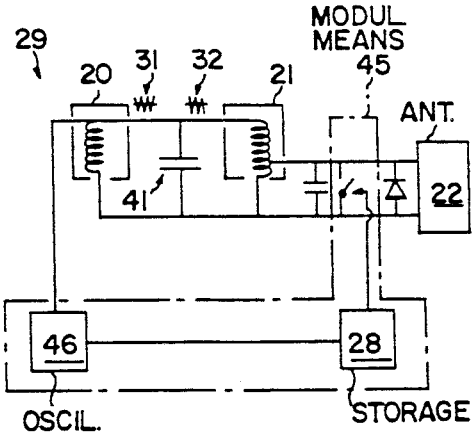
FIG. 5 is the block diagram of the embodiment of the responder antenna in accordance with a variant of the embodiment.

Referring to the drawings, it can be seen that the device for the detection of the passage of at least one mobile body 2 through at least one defined location 3 of its movement along a path 4 in the interior of a space in respect to which the said movements of the mobile body are evaluated, conventionally comprises two separate systems or elements 5, 6, namely an interrogation element 5 and a responder 6. One of the two separate elements is connected to the mobile body, the other is fixed in particular to a support 6a located appreciably continuously on the path along which the mobile body is displaced.

In the example shown, the interrogation element 5 is connected with the mobile body 2 and the responder 6 is fixed; however, without departing from the scope of the invention it is possible for the interrogation element to be fixed and the responder to be mobile.

The interrogation element 5, which itself comprises a transmission subsystem or element 7 and a reception subsystem or element 8, is connected to a processing means 9 for the data received. This element is connected to an electric power source (not shown) to assure its operation.

The responder 6 is of the passive type, because it is not provided with its own electric power supply by means of either a battery or connection with the electrical net.

Therefore it is supplied by means of the signal received from the interrogation element.

The transmitting element 7 comprises two transmitters 10, 11, the transmissions of which are appreciably directed towards a location 12 fixed in relation to the interrogation element, where the passage of a location 13, which is fixed in respect to the responder, is monitored.

One of these locations 12, 13 might continuously be to a large degree be confused with the location 3 of the path along which the passage of the mobile body 2 is monitored. The locations 12, 13 are only confused at the moment when the mobile body passes the fixed point 3 of the path 4.

One (10) of the transmitters 10, 11 transmits a high-frequency signal 14 in the form of an electromagnetic wave, the other, 11, transmits a signal 15 of a very low frequency.

Each one comprises a source 16, 17 and an antenna 18, 19, adapted and tuned to the transmitted frequency.

The responder 6 mainly comprises antenna elements 20, 21, 22, adapted and tuned to receive the previously mentioned signals 14, 15. A non-linear component 23, such as a diode, is connected to these elements which, after the responder has received the previously mentioned two signals, mixes them in a known manner and immediately re-transmits these mixed signals in the form of a modulated carrier wave 24 in the direction of at least one antenna 25, which comprises the receptor 8.

In the interrogation element 5, the transmission antenna 18 for a high-frequency signal 14 and the antenna 25 for receiving the modulated carrier wave 24 are mixed in the example shown, and therefore these antennas 18, 25 are connected by a circulator 27 to the high-frequency source 16 and the internal circuit 26 of the receptor 8.

In the case where a plurality of mobile bodies circulate over the path 4, the above described device also comprises means 28 for the purpose of identifying at least one of these mobile bodies 2 and at least one of the fixed locations 3 of the path 4.

In order to be able to determine the direction of the movement of the mobile body, the responder 6 comprises a double reception circuit 29 of the same signal, and the antennas 20, 21 of this double circuit are connected with each other in a direction parallel to the path of the mobile body.

The two antennas 20, 21 of this double circuit 29 of the responder are preferably and more particularly symmetrically disposed, i.e. at the same distance from both ends of their retransmitting antenna 22.

They are designed in the form of printed circuits.

In accordance with an essential characteristic of the invention the double reception circuit 29, which comprises the responder, consists of two elements 20, 21 which, when the mobile body passes the monitoring location, generate two signals 31, 32 of an appreciably equivalent nature. These elements 20, 21 are designed and connected with each other in such a way as to give opposite values to at least one of the characteristics of these signals 31, 32 which, when combined, form at least one resulting signal R. At least at one fixed location 3, 13 of the passage of the transmitter 5 at right angles to the responder 6, at least one of the characteristics of the resulting signal R changes, in an abrupt fashion in accordance with a discernible amplitude variation, from possible other variations of the characteristics considered in connection with the said resulting signal R. It thus constitutes a particularly electric phenomenon hereinafter called top 30 which defines two distinct portions $R_a$, $R_b$ in the resulting signal R, each one of a certain length $T_1$, $T_2$.

In accordance with a characteristic of the invention, the very low frequency signal 15 is transmitted by the corresponding transmission element 7 in the form of a magnetic field with the help of an antenna 19 which embodies a primary winding 19. The two antennas 20, 21 of the double reception circuit 29 of the responder, adapted and tuned to this frequency, comprise two secondary windings 20, 21 which are arranged such that, during the passage of the primary winding 19, each one is not only exposed to the magnetic field emitted by the said primary winding, but also in such a way that, during an intermediate stage, they are both simultaneously exposed to it. They are oppositely connected in such a way as to create, during the intermediate stage of the passage of the primary winding 19, in these secondary windings 20, 21, when simultaneously exposed to the magnetic field, induced currents 31, 32 of absolute values which are appreciably the same but of opposite sign.

The resulting signal R which in this case is an induced electrical current is thus obtained in accordance with the principle of a differential transformer according to which one primary winding 19 transmits energy to two secondary windings 20, 21.

In effect, since these secondary windings are oppositely connected and disposed near each other along the path of the mobile body which supports the primary winding 19, at the time when the said primary winding 19 is above one of the secondary windings 20, 21. It thus is possible to obtain in the secondary winding a current 31, 32 of a certain absolute value, but always of a phase opposite to that which is created in the other secondary winding during a symmetrical position of the primary winding.

In accordance with the displacement of the primary winding 19 in the axis of the path, one of the secondary currents undergoes a reduction while the other undergoes an increase, when the primary winding 19 passes between the two secondary windings 20, 21.

In the case according to the invention, when the range of the primary winding 19 and/or the distance separating the two secondary windings 20, 21 along the path 4 is such that, at least in an intermediate position of the primary winding 19 in respect to the secondary windings 20, 21, said primary winding 19 induces in the secondary windings currents which, once combined to produce the resulting signal R, cancel each other out. This occurs particularly because of their opposite phases during a time $T_0$, which in particular depends on the speed of the relative movements of the transmitter 5 and the responder 6 along the path 4.

It is this concept of a double circuit 29 which allows the creation of a least one top 30 of a length $T_0$, which is easily recognizable and which assures the precision of the detection by its abrupt unexpected occurrence.

To facilitate the understanding of this phenomenon, some graphs of the evolution as a function of time of the envelope of the signals used in the working of the device according to the invention have been drawn (FIGS. 6 to 9). These graphs are set over the same time scale.

Figures 6, 7, 8, 9:
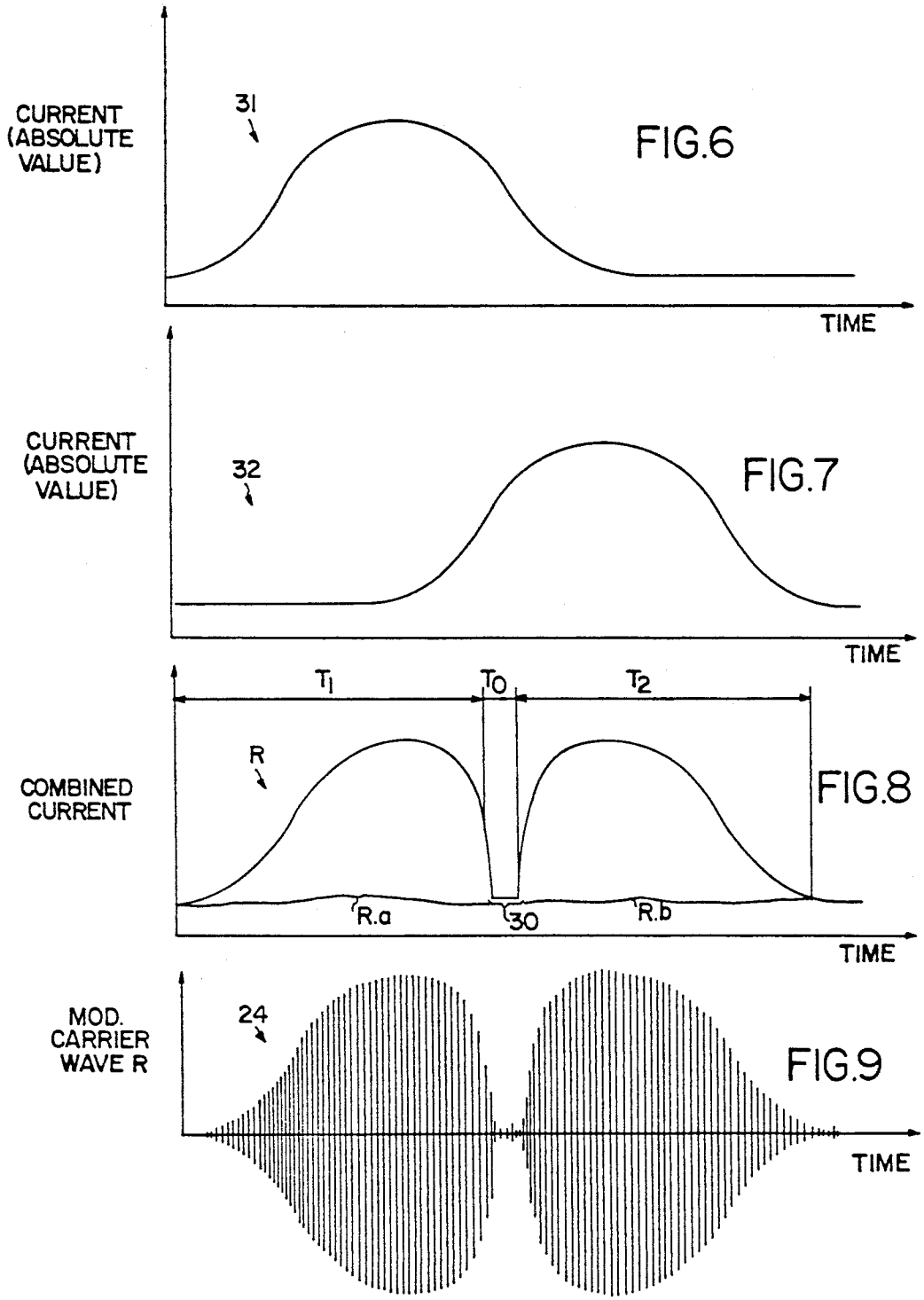
FIGS. 6 to 9 are various graphs of the variation as a function of time of the signal envelope used in the device of the invention.

In particular in FIGS. 6 and 7 the evolution graphs of one characteristic of each one of the currents 31, 32 induced in the two secondary windings 20, 21 are represented and considered as absolute value.

In FIG. 8 the evolution graph of the resulting signal R is represented, regardless of the manner in which the current composed by the two currents 31, 32, induced in the secondary windings 20, 21, is also taken at absolute value.

In FIG. 9 one of the graphs of the signal re-transmitted by the responder at the time of its activation by the interrogating element is represented.

As shown there, the top 30 previously mentioned is enclosed by two portions of the resulting signal, which act in concert over respective lengths $T_1$ and $T_2$.

Although this is not shown, it is understood that the lengths $T_1$ and $T_2$ of the portions enclosing the top 30 are the same when the windings are identical.

In a preferred embodiment, the two windings 20, 21 are asymmetric, so that they generate, regardless of the speed of movement of the mobile body, signals 31, 32 of lengths different from each other in order to impart to the portions $R_a$, $R_b$ of the resulting signal R, which enclose the top 30, lengths $T_1$ and $T_2$, themselves different and thus discernible. The windings 20, 21 of each responder situated in the path of the interrogation element are oriented in a predetermined and known manner in such a way that at the time of the processing by the responder the portions $R_a$, $R_b$ of the resulting signal R indicate the direction of movement of the interrogation element in respect to the said responder. The processing means 9 of the interrogation element comprises at least one means 33, 34, generating pulses in accordance with a pre-determined frequency, at least one means 35, 36 for counting the number $N_1$, $N_2$ of pulses delivered by the generating means during the length of at least one of the components of the resulting signal, which are the components $R_a$, $R_b$ and the top 30 and which are re-transcribed in the signal 24 transmitted by the responder, and at least one comparison means 37 between each of the counted pulse numbers $N_1$, $N_2$ and the processing of at least one signal 39 reflecting the status of the comparison and thus characterizing the direction of the passage of the mobile body.

The interrogation element preferably comprises at least a measuring device 40 for the speed of movement of the mobile body, which is independent of its processing means 9 and generates at least one signal 41 proportional to the speed. The processing means comprises a plurality of pulse generating means 33, 34, one of which, 33, reads the signal 41 of the speed measuring device 40 and generates pulses of a frequency proportional to the said speed in such a way, that the device 35 counting pulses during the length of at least one of the components of the resulting signal, which are the portions $R_a$, $R_b$ and the top 30 transcribed in the signal 24 transmitted by the responder, counts the pulse numbers $N_1$, $N_2$. Their orders of magnitude are independent of the speed of the mobile body.

By this means it is possible to definitely determine the direction of movement without error.

The measuring means for the speed of the mobile body which influences the pulse generation means is, for example, of the type based on counting speed by means of the Doppler effect.

For determining the instant speed V of the vehicle during its passage at right angles to the responder, the processing means of the interrogation element preferably comprises at least one pulse generating means 34 in accordance with a pre-determined frequency and, at least one counting means 36 for pulses during the length of at least one of the components of the resulting signal, which are the portions $R_a$, $R_b$ and the top 30 transcribed in the signal 24 transmitted by the responder.

The frequency of the pulses generated by the above mentioned means 34 is preferably fixed.

Thus, this counting redundancy allows the securing of the received information and an increase in its accuracy.

Advantageously, the high-frequency signal is located among the weakest frequencies in the UHF band.

The high-frequency signal is preferably on the order of 1 GHz and its strength is very low, for example, 40 mW, so that the risk of the creation of radio-electric disturbances is limited and the transmissions can be put within the limits of very strict radio-electric standards in this area.

Regarding the signal of very low frequencies, it is selected from among the available medium frequencies on the order of from 1 to 10 MHz and is, for example, approximately 4 MHz.

Optimization of the operation of the response system is achieved by means of the following elements: A double flat differential winding 20, 21, tuned to a medium frequency, overriding the magnetic field, a plated UHF antenna 22, overriding the electromagnetic wave, a component 23 (diode) characterized by its non-linear properties, and impedance adaptation elements 42 (connected to an auto-transformer), allowing the transmission of the largest amount of energy to the diode and the insulating elements 43, 44 (end of the line with constant distribution).

The element is provided as a standard printed circuit of epoxy glass.

For re-transmission to the interrogator by means of a radio circuit of the characteristic signal of the presence of a responder at right angles to it during the passing of the vehicle by a fixed spot of the path, the responder insures the transposition of its differential characteristics in very high frequency, so that it is possible to take advantage of the properties of electro-magnetic radiation and of the weak forces required.

For this very high frequency, the responder is equipped with a single wide band antenna which allows receiving a carrier wave frequency and the re-transmission to the interrogator of the first harmonics created by the responder.

This plated antenna is placed between the two previously mentioned secondary windings so as to take better advantage of the large radiation pattern it furnishes and produces in place of the magnetic field connected to the windings.

Furthermore, the dimensions of the element are reduced in the same proportion.

The responders can be structurally tuned advantageously to the different medium frequencies in such a way as to create numeric words.

The medium frequency transmitter will in this case furnish the different frequencies required by means of the printed windings.

The plated UHF antenna, for example of the dipole type, is placed in their center.

The transmitting subsystem "antennas" thus is comprised of transmission frame antennas which are excited by one or a plurality of medium frequency sources and a sole high frequency antenna, excited by a tuned source.

The connection between the medium frequency transmitter and the responder preferably is made by critical coupling in order to allow the element to traverse a very broad frequency range.

In accordance with the invention, each responder comprises: at least one storage means 28 of at least one message, particularly numeric, and at least one means 45 for modulating the signal 24 transmitted by the said responder towards the interrogation element dependent of the message contained in the storage means.

For example, in accordance with the invention, the means 45 of modulating the signal 24 comprises an oscillator 46 and the storage means comprises at least a shift register memory. These modulating means 45 and storage means 28 draw their operating power from the very low frequency signal received by the responder.

Advantageously and in order to do away with height problems connected with the body of the vehicle in respect to the path, the receiver means of the interrogator comprise at least one means 47 as a power divider which separates the signal received by the interrogation element from the responder into two channels, at least two means 48, 49 which, particularly synchronized with the high frequency signal produced by the corresponding source 16, induce de-phasing of pi/2 between the signals which circulate through each one of the previously mentioned channels, at least one means 50, 51 which increases at least one of the characteristics of each signal two-fold, and at least one means 52, which calls up the characteristics of the increased or squared signals and produces a composite signal addressed to the processing means 9 of the interrogation element.

The UHF antenna 22 has a large range of frequencies which allows covering the medium frequency fields, and a pass band range sufficiently wide to permit the passing of the spectral bands of the first harmonics.

In the drawings the impedance adaptation and line insulating elements in the area of the mixing diode are also shown.

The responder circuit is mounted in a plastic housing which is transparent to UHF waves and the magnetic field and sufficiently strong to resist more or less strong shocks which are produced in the course of the passage of the vehicles at great speed, as well as splashes of other materials, such as water, grease or oil.

What is claimed is:

1. A device for detecting the passage of at least one mobile body (2) through a defined location (3) along a path (4) within a space in which displacements of the mobile body are evaluated, comprising:

an interrogation system (5) having a transmission subsystem (7), reception subsystem (8), and a processing means (9) connected to said reception subsystem (8) for processing data received therefrom, said transmission subsystem having a high frequency transmitter (10) for transmitting a high frequency signal in the form of an electromagnetic wave and a low frequency transmitter for establishing a relatively low frequency signal in the form of a magnetic field, each of said transmitters having a source (16, 17) and a transmitting antenna (18, 19), said reception subsystem having a reception antenna (25); and a passive responder (6), one of said responder and interrogation system mounted to the mobile body and the other of said responder and interrogation system being fixed to a support (6a) located on the path, said responder having first and second low frequency antennas (20, 21) tuned to receive the low frequency signal and offset from each other in a direction parallel to said path, high frequency antenna (22) tuned to receive the high frequency signal, and a non-linear element (23) connected to said first and second low frequency antennas and said high frequency antenna for mixing the low frequency signal received by said first and second low frequency antennas and said high frequency antenna to supply a resultant (R) in the form of a modulated carrier wave transmitted over said high frequency antenna (22) to said reception antenna (25); and wherein said first and second low frequency antennas are spaced apart from each other in a direction generally parallel to the path, said first and second low frequency antennas are two secondary windings to which said transmitting antenna (19) of said high frequency transmitter (10) serves as a primary winding, said secondary windings arranged such that during passage of the mobile body adjacent to the defined location said secondary windings receive said low frequency signal successively and over a time interval ($T_o$) both secondary windings receive said low frequency signals at about the same amplitude and opposite polarity such that said reception subsystem receives said resultant (R) in a pattern having as components: two distinct portions ($R_a$, $R_b$) of lengths ($T_1$, $T_2$), each distinct portion corresponding to a different one of said secondary windings receiving a dominant portion of said low frequency signal, and a top (30) separating said distinct portions corresponding to said time interval ($T_o$).

2. A device in accordance with claim 1, characterized in that said two secondary windings (20, 21) are asymmetric, so that they generate, regardless of the speed of displacement of the mobile body, signals (31, 32) of lengths different from each other in order to impart to said distinct portions ($R_a$, $R_b$) of the resultant (R) lengths ($T_1$ and $T_2$ ) which are different and thus discernible and, said secondary windings (20, 21) are oriented in such that the distinct portions ($R_a$, $R_b$) of the resulting signal (R) indicate the direction of displacement of the interrogation system in respect to the said responder, and the processing means (9) of the interrogation system comprises:

at least one means (33, 34), generating pulses in accordance with a pre-determined frequency, at least one means (35, 36) for counting the number ($N_1$, $N_2$) of pulses delivered by the generating means during the length of at least one of the components of the pattern and, at least one comparison means (37) between each of the counted pulse numbers ($N_1$, $N_2$) and the processing of at least one signal (39) reflecting the status of the comparison and thus indicating the direction of the passage of the mobile body.

3. A device in accordance with claim 2, characterized in that for determining the instant speed (V) of the mobile body during its passage at right angles to the responder, the processing means of the interrogation system preferably comprises at least one pulse generating means (34) in accordance with a predetermined frequency and at least one counting means (36) for pulses during the length of at least one of the components of the resultant.

4. A device in accordance with claim 1, characterized in that the high frequency signal is located among the weakest frequencies in the UHF band.

5. A device in accordance with claim 4, characterized in that the high frequency signal is on the order of 1 GHz and its strength is about 40 mW such that the risk of the creation of radio-electric disturbances is limited.

6. A device in accordance with claim 1, characterized in that the low frequency signal is between 1 to 10 MHz.

7. A device in accordance with claim 1, characterized in that the high frequency antenna of the responder:

is placed between the two secondary windings (20, 21), is of the large band type, which allows receiving a carrier wave frequency and the retransmission to the interrogator of the first harmonics created by the responder.

8. A device in accordance with claim 1, characterized in that the reception subsystem of the interrogator comprises:

at least one means (47) to separate the signal received by the interrogation system from the responder into two channels, at least two means (48, 49) which, synchronized with the high frequency signal produced by the corresponding source (16), induce phase demodulation of pi/2 between the signals which circulate through each one of the channels, at least one means (50, 51) which increases at least one of the characteristics of each signal two-fold, and at least one means (52), which calls up the characteristics of the increased signals and produces a composite signal addressed to the processing means (9) of the interrogation system.

9. A device in accordance with claim 1, characterized in that said responder comprises:

at least one means (28) for storing at least one message, and, at least one means (45) for modulating the signal (24) transmitted by the said responder towards the interrogation system dependent of the message contained in the storage means.

* * * * *